US009820545B2

(12) United States Patent
Simonson

(10) Patent No.: US 9,820,545 B2
(45) Date of Patent: Nov. 21, 2017

(54) HAIR STRAIGHTENING/CURLING METHOD AND APPARATUS

(71) Applicant: Debra Simonson, Phoenix, AZ (US)

(72) Inventor: Debra Simonson, Phoenix, AZ (US)

( * ) Notice: Subject to any disclaimer, the term of this patent is extended or adjusted under 35 U.S.C. 154(b) by 0 days.

(21) Appl. No.: 14/742,127

(22) Filed: Jun. 17, 2015

(65) Prior Publication Data

US 2015/0366315 A1 Dec. 24, 2015

Related U.S. Application Data

(60) Provisional application No. 62/014,836, filed on Jun. 20, 2014.

(51) Int. Cl.
*A45D 2/00* (2006.01)
*A45D 2/12* (2006.01)

(52) U.S. Cl.
CPC ..... *A45D 2/127* (2013.01); *A45D 2/001* (2013.01); *A45D 2/122* (2013.01)

(58) Field of Classification Search
CPC . A45D 2/18; A45D 2/127; A45D 2/38; A45D 7/045; A45D 7/065; A45D 19/0016; A45D 19/0025; A45D 2/001; A45D 20/02
USPC ..... 132/134, 135, 282, 281, 277, 279
See application file for complete search history.

(56) References Cited

U.S. PATENT DOCUMENTS

| | | | | |
|---|---|---|---|---|
| 3,871,388 | A * | 3/1975 | Leoci | A45D 2/00 132/223 |
| 3,983,887 | A * | 10/1976 | Chan | A45D 8/20 132/277 |
| 5,025,850 | A * | 6/1991 | Simpson | A45D 2/38 132/223 |
| 5,156,172 | A * | 10/1992 | Tancredi | A45D 19/0025 132/207 |
| 6,041,791 | A * | 3/2000 | Belmonte | A45D 2/127 132/222 |
| 7,021,317 | B1 * | 4/2006 | Nathaniel | A45D 19/0016 132/270 |
| 8,033,286 | B2 * | 10/2011 | Perry | A45D 19/0025 132/208 |
| 2004/0045571 | A1 * | 3/2004 | Kelsey | A45D 2/001 132/224 |

* cited by examiner

*Primary Examiner* — Todd E Manahan
*Assistant Examiner* — Brianne Kalach
(74) *Attorney, Agent, or Firm* — Parsons & Goltry; Robert A. Parsons; Michael W. Goltry

(57) ABSTRACT

A hair styling accessory includes an elongated hair board having a widened end and a narrowed end with elongated edges extending between the widened end and the narrowed end, a plurality of holes extend through the hair board from an upper surface to a lower surface. At least one end-clip having open and closed orientations and biased into the closed orientation. The at least one end-clip is designed to be positioned in the closed orientation over the narrowed end of the hair board and to grip a lock of hair against one of the upper and lower surfaces. At least one side-clip having open and closed orientations and biased into the closed orientation. The at least one side-clip is designed to be positioned in the closed orientation over one of the elongated edges of the hair board and to grip the lock of hair.

9 Claims, 10 Drawing Sheets

HAIR STRAIGHTENING/CURLING METHOD AND APPARATUS

CROSS-REFERENCE TO RELATED APPLICATION

This application claims the benefit of U.S. Provisional Patent Application No. 62/014,836, filed 20 Jun. 2014.

FIELD OF THE INVENTION

This invention relates to hair styling accessories and more particularly, the present invention relates to devices for shaping hair.

BACKGROUND OF THE INVENTION

In the hair styling industry, the tasks of hair straightening and hair curling are performed the most often. Hair curlers are well known and are provided in a large array of different forms. However, all hair curlers are only useful to curl hair and generally in a very specific fashion, size, etc. The number and type of hair straightening devices are very limited and are useful only for straightening hair. Further, hair straightening devices are generally complicated and difficult to use. Thus, hair styling shops and hair stylers must invest in and store a large variety of different devices and accessories.

It would be highly advantageous, therefore, to remedy the foregoing and other deficiencies inherent in the prior art.

Accordingly, it is an object of the present invention to provide new and improved hair shaping devices and methods of use.

It is another object of the present invention to provide new and improved hair straightening devices that are easier to use and less expensive.

It is another object of the present invention to provide new and improved hair shaping devices that are useful in both hair straightening and hair curling projects.

It is another object of the present invention to provide new and improved hair shaping devices and methods of use for both hair straightening and hair curling projects.

SUMMARY OF THE INVENTION

Briefly to achieve the desired objects and advantages of the instant invention in accordance with a preferred embodiment a hair styling accessory is provided. The hair styling accessory includes an elongated hair board having a widened end and a narrowed end with elongated edges extending between the widened end and the narrowed end, a plurality of holes extend through the hair board from an upper surface to a lower surface. The accessory also includes at least one end-clip having open and closed orientations and biased into the closed orientation. The at least one end-clip is designed to be positioned in the closed orientation over the narrowed end of the hair board and to grip a lock of hair against one of the upper surface and the lower surface. The accessory further includes at least one side-clip having open and closed orientations and biased into the closed orientation. The at least one side-clip is designed to be positioned in the closed orientation over one of the elongated edges of the hair board and to grip the lock of hair against one of the upper surface and the lower surface.

To further achieve the desired objects and advantages of the present invention a hair styling accessory includes a convertible elongated hair board having a widened end and a narrowed end with elongated edges extending between the widened end and the narrowed end and a plurality of holes extending through the hair board from an upper surface to a lower surface. The convertible hair board is constructed of flexible material and includes one of relatively stiff elongated pins or rails removably attached to extend approximately the length of each of the elongated edges to stiffen the hair board into a hair straightening device. At least one end-clip having open and closed orientations and biased into the closed orientation is included. The at least one end-clip is designed to be positioned in the closed orientation over the narrowed end of the hair board and to grip a lock of hair against one of the upper surface and the lower surface. At least one side-clip having open and closed orientations and biased into the closed orientation is also included. The at least one side-clip is designed to be positioned in the closed orientation over one of the elongated edges of the hair board and to grip the lock of hair against one of the upper surface and the lower surface.

To further achieve the desired objects and advantages of the present invention a method of performing hair styling comprises the steps of selecting one of a hair straightening procedure and a hair curling procedure. The hair straightening procedure includes the steps of providing a convertible elongated hair board having a widened end and a narrowed end with elongated edges extending between the widened end and the narrowed end and a plurality of holes extending through the hair board from an upper surface to a lower surface, the convertible hair board comprising flexible material and including one of relatively stiff elongated pins or rails removably attached to extend approximately the length of each of the elongated edges to stiffen the hair board into a hair straightening device; providing at least one end-clip having open and closed orientations and biased into the closed orientation, positioning a lock of hair on the hair board and extending approximately the length of the hair board, positioning the at least one end-clip in the closed orientation over the narrowed end of the hair board and gripping the lock of hair against one of the upper surface and the lower surface; and providing at least one side-clip having open and closed orientations and biased into the closed orientation, positioning the at least one side-clip in the closed orientation over one of the elongated edges of the hair board and gripping the lock of hair against the one of the upper surface and the lower surface. The hair curling procedure includes the steps of providing a convertible elongated hair board having a widened end and a narrowed end with elongated edges extending between the widened end and the narrowed end, a plurality of holes extending through the hair board from an upper surface to a lower surface, the convertible hair board comprising flexible material; providing at least one end-clip having open and closed orientations and biased into the closed orientation, positioning a lock of hair on the hair board and extending approximately the length of the hair board, positioning the at least one end-clip in the closed orientation over the narrowed end of the hair board and gripping the lock of hair against one of the upper surface and the lower surface; providing at least one side-clip having open and closed orientations and biased into the closed orientation, positioning the at least one side-clip in the closed orientation over one of the elongated edges of the hair board and gripping the lock of hair against the one of the upper surface and the lower surface; and rolling the flexible hair board to produce a curling effect in the lock of hair.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF THE DRAWINGS

Figure 1:
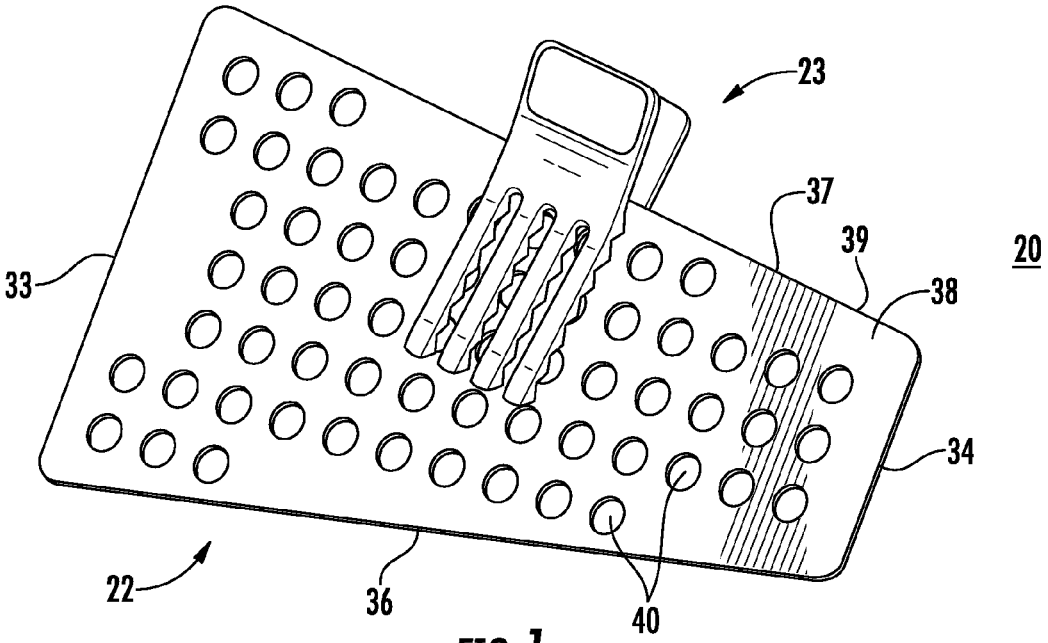
FIG. 1 is a perspective view of a hair straightening device according to the present invention.

Turning now to the drawings in which like reference characters indicate corresponding elements throughout the several views, attention is directed to FIG. 1 which illustrates a hair straightening device 20 that includes a hair board 22 and at least one clip 23. With additional reference to FIG. 2, hair board 22, in the preferred embodiment, is a flat, planar member having a widened end 33, a narrowed end 34, side edges 36 and 37 extending therebetween, and opposed surfaces 38 and 39. In a preferred embodiment, hair board 22 is preferably approximately 7 inches long (side edges 36 and 37), approximately 4 inches wide at widened end 33, and approximately 2 inches wide at narrowed end 34. It will be understood that the above lengths are only for purposes of example and the narrowed end of the elongated hair board is preferably in a range of one inch to three inches long, the widened end of the elongated hair board is preferably in a range of three inches to five inches long, and the elongated edges are preferably in a range of five inches to eight inches long. It should be understood that Hair board 22 can further include a plurality of apertures 40 extending therethrough from surface 38 to surface 39. In the preferred embodiment hair board 22 is fabricated of plastic, but can be formed from wood, metal and the like, and should be sufficiently stiff to hold hair locks in a straight position. The plurality of apertures 40 permit airflow therethrough to facilitate drying the hair carried thereby, either from blow drying or natural air drying.

Figure 3:
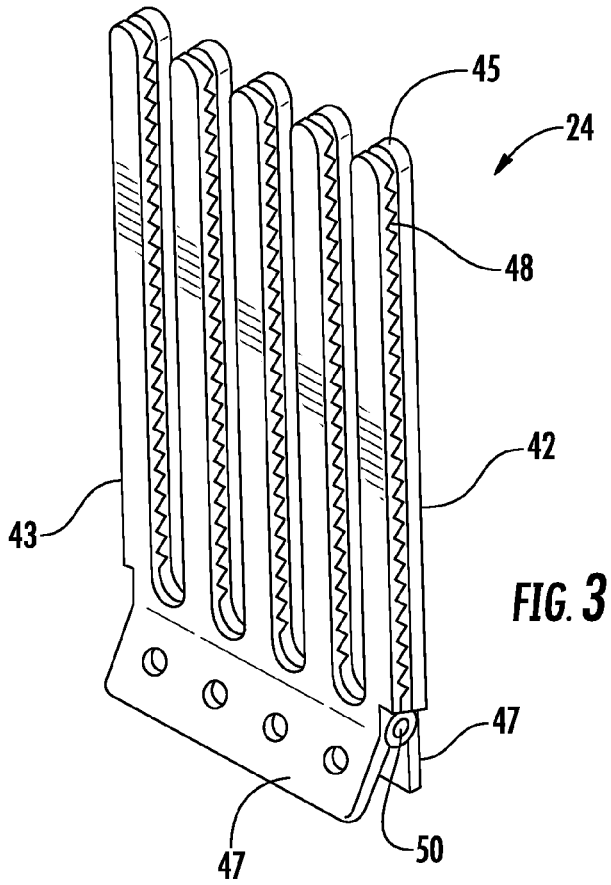
FIG. 3 is a perspective view of an end-clip of the hair straightening device according to the present invention.

Turning to FIG. 3, end-clip 24 is illustrated. End-clip 24 includes a pair of combs 42 and 43, each having a plurality of straight teeth 45, approximately 3 inches long in the preferred embodiment, extending from a backing 47. Serrations 48 are formed on an inner surface of teeth 45 of each comb 42 and 43. Combs 42 and 43 are joined together in an overlying relationship, with teeth 45 of comb 43 overlying teeth 45 of comb 43 with the serrations 48 abutting one another. Combs 42 and 43 are movable between an open position wherein teeth 45 of comb 42 and 43 are angularly spaced apart and a closed position wherein teeth 45 of comb 42 and 43 are positioned adjacent one another, by a biasing member 50 attached at the junction of teeth 45 and backing 47 of combs 42 and 43. Backing 47 of combs 42 and 43 overly each other in a divergent manner when in the closed position. Biasing member 50 urges combs 42 and 43 to the closed position, and can be overcome by squeezing backing 47 of combs 42 and 43 together, separating teeth 45 against the bias. The width of end-clip 24 is less than the width of narrowed end 34 of hair board 22, and extends from narrowed end 34 toward widened end 33 when properly positioned on hair board 22.

Figure 4:
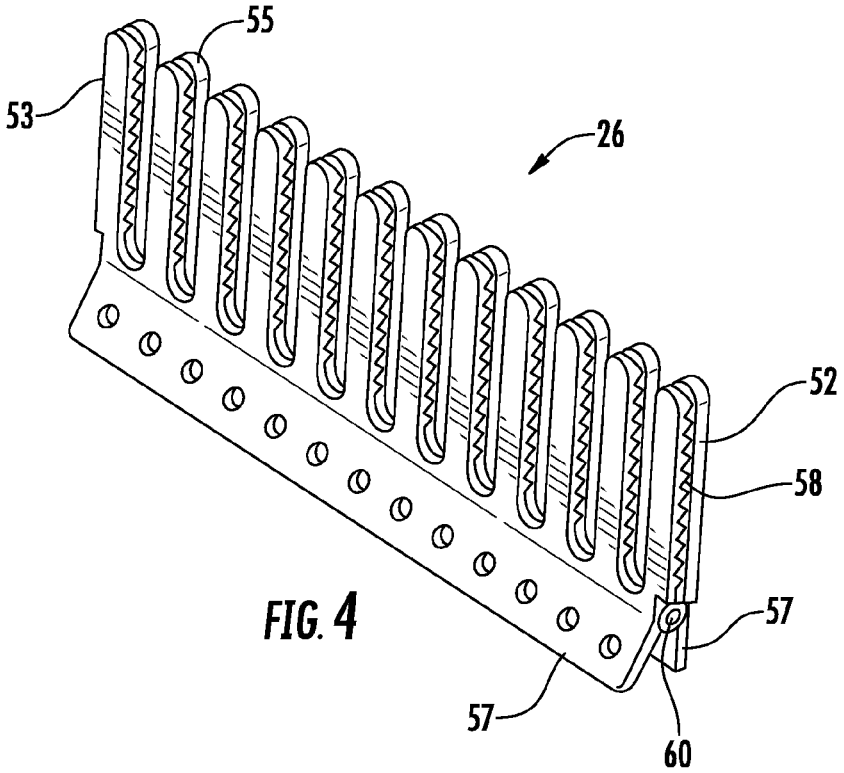
FIG. 4 is a perspective view of a side clip of the hair straightening device according to the present invention.

Referring now to FIG. 4, side-clip 26 is illustrated. Side-clip 26 includes a pair of combs 52 and 53, each having a plurality of straight teeth 55, approximately 2 inches long in the preferred embodiment, extending from a backing 57. Serrations 58 are formed on an inner surface of teeth 55 of each comb 52 and 53. Combs 52 and 53 are joined together in an overlying relationship, with teeth 55 of comb 53 overlying teeth 55 of comb 53 with the serrations 58 abutting one another. Combs 52 and 53 are movable between an open position wherein teeth 55 of comb 52 and 53 are angularly spaced apart and a closed position wherein teeth 55 of comb 52 and 53 are positioned adjacent one another, by a biasing member 60 attached at the junction of teeth 55 and backing 57 of combs 52 and 53. Backing 57 of combs 52 and 53 overly each other in a divergent manner when in the closed position. Biasing member 60 urges combs 52 and 53 to the closed position, and can be overcome by squeezing backings 57 of combs 52 and 53 together, angularly separating teeth 55 against the bias. The length of side-clip 26 is less than the length (distance from end 33 to end 34) of side edges 36 and 37, and extends transversely from one of side edges 36 and 37 to the other when properly positioned.

Figure 2:
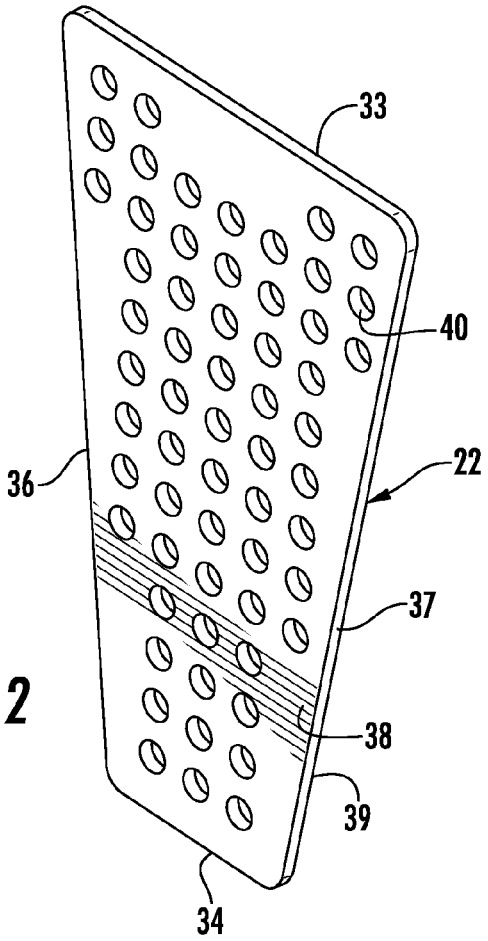
FIG. 2 is a perspective side view of a hair board included as a component of the hair straightening device of FIG. 1.
Figure 5:
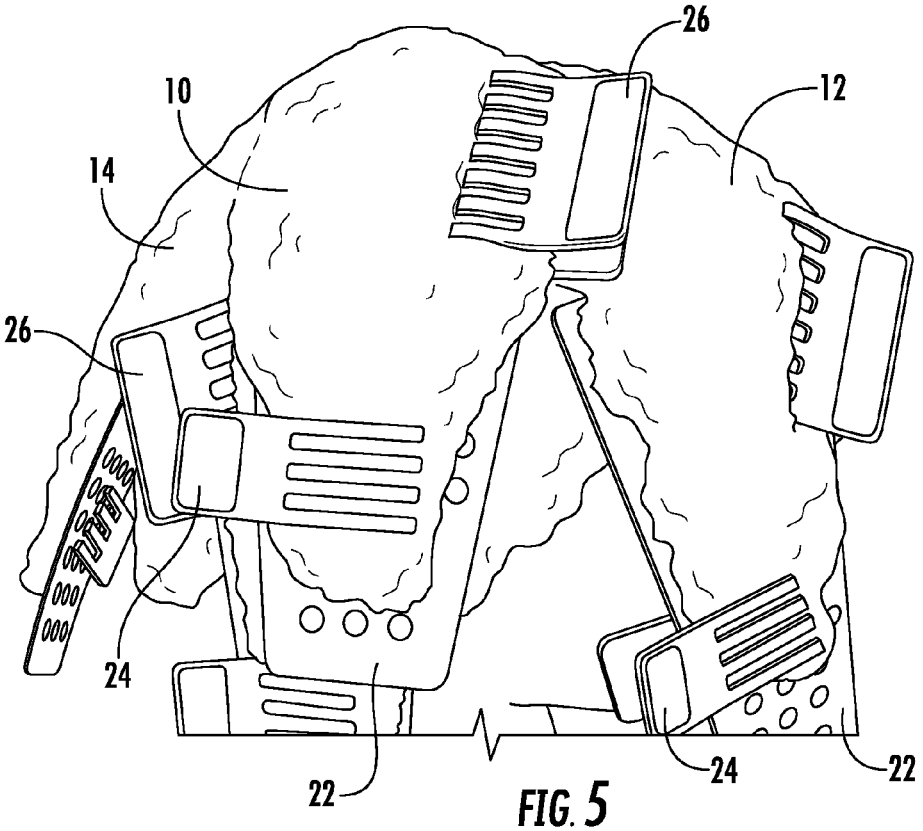
FIG. 5 is a perspective view illustrating a lock of hair being positioned on the hair board.

Turning to FIG. 5, with continued reference to FIG. 1, a method of straightening hair is illustrated. In this example, a head 10 is illustrated having hair 12 to be straightened. A lock 14 of hair 12 is separated from the rest and a hair straightening device 20 is employed to convert curly hair, frizzy hair, kinked hair and the like to a more straightened condition. In FIG. 5, lock of hair 14 is stretched over one of opposed surfaces 38 or 39 of hair board 22, extending from widened end 33 to narrowed end 34. Widened end 33 is positioned proximate the base of lock 14 while the end of lock 14 is positioned proximate narrowed end 34 of hair board 22. As the lock of hair is straightened, its shape generally matches the shape of hair board 22 (FIG. 2). Lock of hair 14 is preferably dampened to allow smoothing and shaping over board 22 and overlying apertures 40. Lock 14 is held in position by clamping the sides and/or ends thereof to narrowed end 34 using end-clip 24. End-clip 24 is moved to the open position, and combs 42 and 43 are positioned overlying lock 14 and the one of surfaces 38 and 39 on which the lock lies, and the opposing one of surfaces 38 and 39, respectively. End-clip 24 is released, permitting biasing member 47 to move end-clip 24 to the closed position, clamping a portion at the end of lock 14 to hair board 22.

Lock 14 is further held in position on board 22 by side-clip 26. Side-clip 26 is moved to the open position, and combs 52 and 53 are positioned overlying lock 14 and the one of surfaces 38 and 39 on which the lock lies, and the opposing one of surfaces 38 and 39, respectively, at one of sides 36 and 37. Side-clip 26 is released, permitting biasing member 57 to move end-clip 26 to the closed position, clamping a portion at the side of lock 14 to hair board 22, preventing hair board from pivoting about end-clip 24. It will be understood that lock 14 may be held in place (straightened) by use of only side-clips 26, in many applications. It will also be understood that an additional side-clip 26 may be placed in a similar fashion on the opposite side of hair board 22 if deemed necessary or desirable. Further, in many applications, only one type of clip (e.g. end-clip 24 or side-clip 26) may be used. Once fully positioned, hair straightening device 20 remains in position as the lock of hair is dried, either by natural air drying or by a hair drier of some sort.

Since hair straightening device 20 is attached to and hangs from an individual's hair, it is provided in a low weight form to reduce the drag on an individual. The plurality of apertures 40 provide a reduced weight as well as increased airflow. Additionally, the shape and size (length/width) of board 22 closely matches the shape of a stretched lock of hair, so as to again reduce the weight by eliminating extra unnecessary materials. That is, the above exemplary dimensions should be kept to a minimum for the specific purposes and applications to reduce the weight as much as possible.

Figure 6:
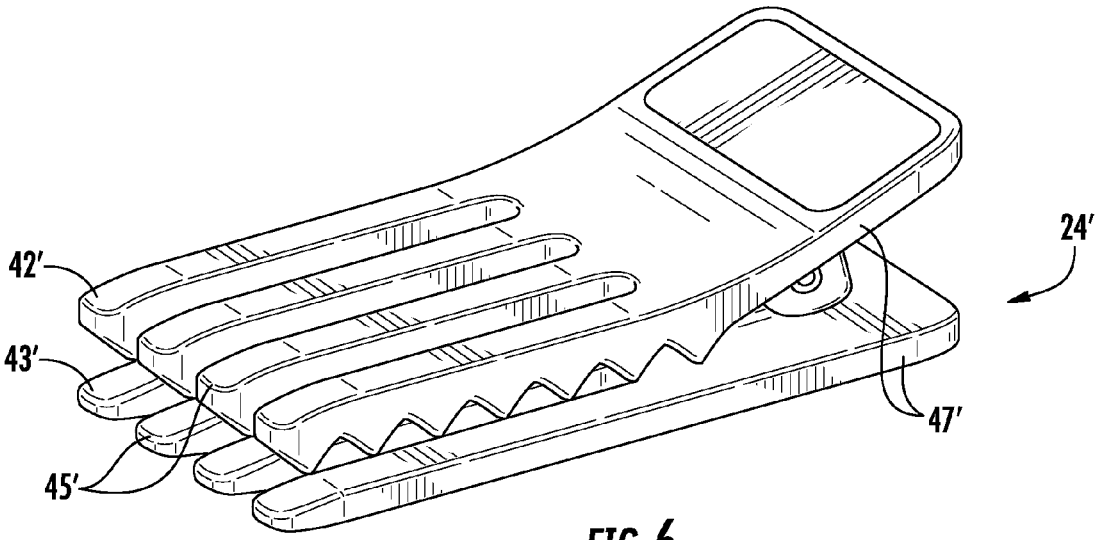
FIGS. 6, 7, and 8 are perspective, side and rear end views illustrating a more specific example of a hair clip according to the present invention.
Figure 7:
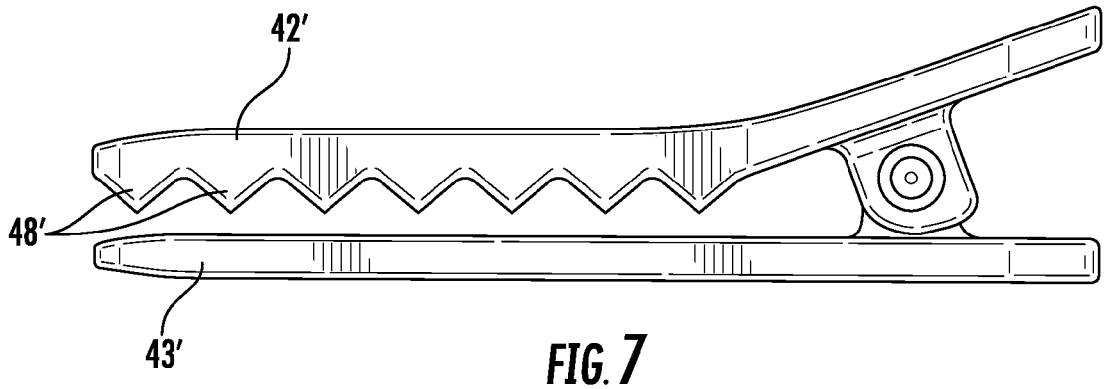
Figure 8:
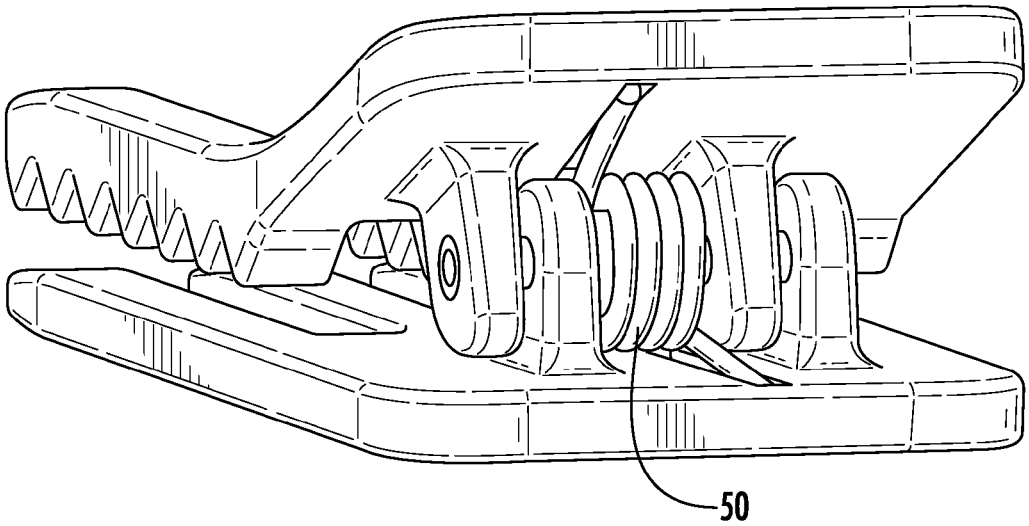

Turning now to FIGS. 6, 7, and 8, a specific example of a clip 24' is illustrated. Basically, clip 24' is similar to either end-clip 24 or side-clip 26, illustrated above. In this example, clip 24' includes a pair of combs 42' and 43', each having a plurality of straight teeth 45', extending from a backing 47'. Serrations 48' are formed on an inner surface of teeth 45' of either or both combs 42' and 43'. Combs 42' and 43' are joined together in an overlying relationship, with teeth 45' of comb 43' overlying teeth 45' of comb 43' with the serrations 48' abutting one another or the adjacent teeth. Combs 42' and 43' are movable between an open position (not shown) wherein teeth 45' of combs 42' and 43' are angularly spaced apart and a closed position wherein teeth 45' of combs 42' and 43' are positioned adjacent one another, by a biasing member 50' attached adjacent the junction of teeth 45' and backing 47' of combs 42' and 43'. Backing 47' of combs 42' and 43' overly each other in a divergent manner when in the closed position. Biasing member 50' urges combs 42' and 43' to the closed position, and can be overcome by squeezing backing 47' of combs 42' and 43' together, separating teeth 45' against the bias.

Figure 9:
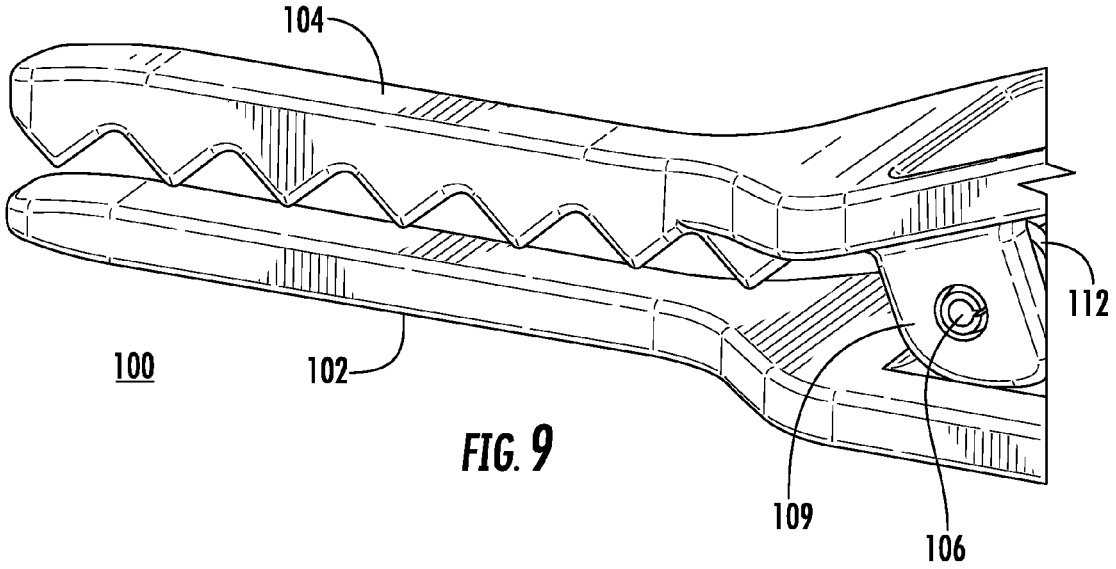
FIGS. 9, 10, and 11 are perspective view, side view and top view, respectively, of another clip for use with the hair board of FIG. 2.
Figure 10:
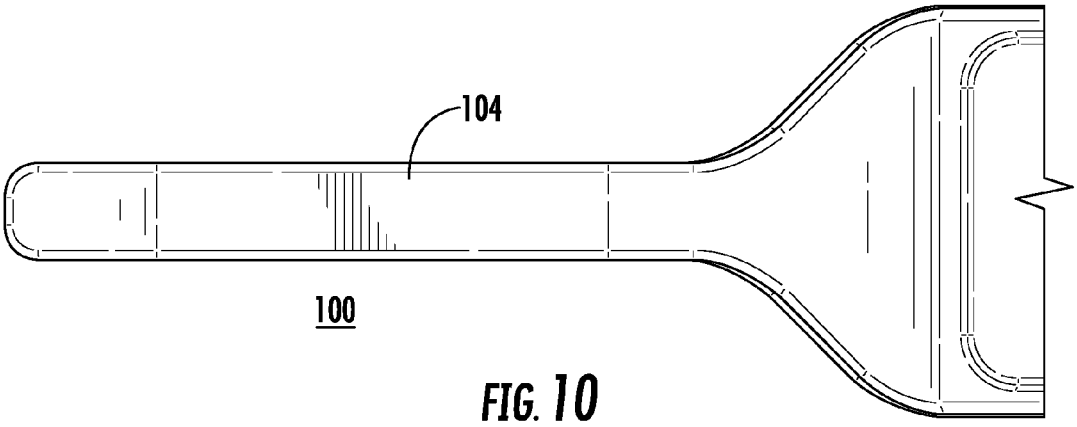
Figure 11:
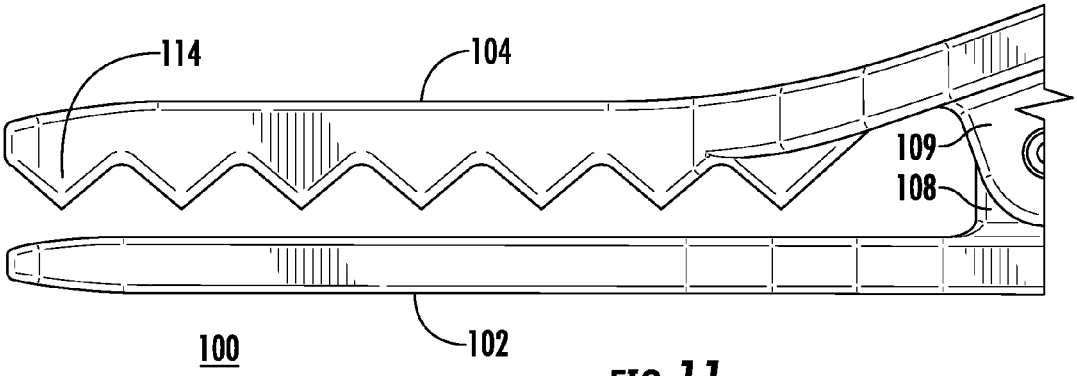

Turning now to FIGS. 9, 10, and 11, another clip 100 is illustrated for use with, for example, hair board 22 of FIG. 2. Clip 100 is referred to herein as a "thin clip" because it includes opposed, elongated lower jaw 102 and elongated upper jaw 104 having a relatively narrow width, e.g. an inch or less. Lower jaw 102 and upper jaw 104 are pivotally attached together adjacent one end (herein the proximate end) by means of a pivot pin 106 extending through inwardly directed ears 108 and 109 formed as an integral part of lower jaw 102 and upper jaw 104, respectively. A torsion spring 112 biases jaws 102 and 104 into a closed orientation as illustrated in FIGS. 7 and 8. A portion of each jaw 102 and 104 extends beyond (to the right in FIGS. 9, 10, and 11) the pivot point and forms a grip for moving jaws from the closed orientation to an open orientation in which they are angularly separated. At least one of jaws 102 and 104 (upper jaw 104 in this example) may have inwardly directed teeth 114 designed to firmly grip hair when applied to, for example, hair board 22 of FIG. 2.

Thin clip 100 is designed to replace or supplement clips 24 and 26 of FIGS. 3 and 4 or clip 24' of FIG. 6. One or more thin clips 100 can be used instead of end-clip 24 and are applied in a fashion similar to the above description for applying end-clip 24 and one or more thin clips 100 can be used instead of side-clip 26 and are applied in a fashion similar to the above description for applying side-clip 26. In this specific example, thin clip 100 is formed of a light plastic or metal material and can reduce the weight of the overall straightening device. Further, since a single type of clip is used for both end and side clips, the use, cost and storage problems are substantially reduced.

Figure 12:
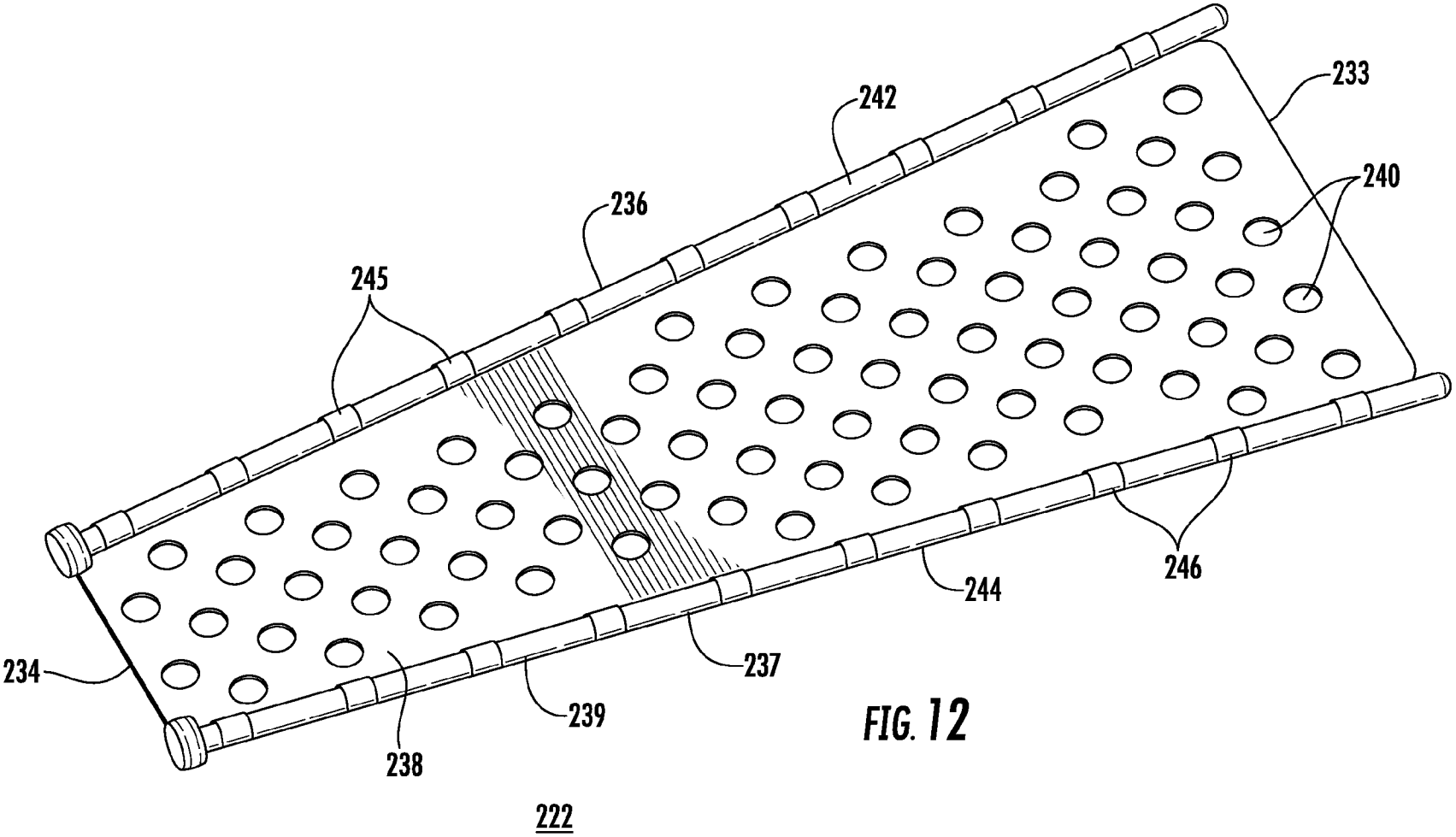
FIG. 12 is a top perspective view of another example of a hair board useful in hair straightening and/or hair curling procedures.

Turning now to FIG. 12, another example of a hair board 222 is illustrated. Hair board 222, in a preferred embodiment, is a flat, planar member having a widened end 233, a narrowed end 234, side edges 236 and 237 extending therebetween, and opposed surfaces 238 and 239 (not visible). In this preferred embodiment, hair board 222 is preferably approximately 7 inches long (side edges 236 and 237), approximately 4 inches wide at widened end 233, and approximately 2 inches wide at narrowed end 234. It will be understood that the measurements expressed are for exemplary purposes only and different lengths and widths can be included for special purposes or applications (e.g. the ranges set forth above). Hair board 222 further includes a plurality of apertures 240 extending therethrough from surface 238 to surface 239. In this preferred embodiment hair board 222 is fabricated of flexible plastic, such as silicone or the like. The plurality of apertures 240 permit airflow therethrough to facilitate drying the hair carried thereby, either from blow drying or natural air drying.

Because hair board 222 is formed of flexible plastic in this specific example, a pair of elongated pins or rails 242 and 244 are provided for a stiffening function. As one specific example, sides 236 and 237 are formed with a plurality of loops 245 and 246, respectively, opening generally in the longitudinal direction. During hair straightening procedures elongated pin 242 is inserted through loops 245 on side 236 and elongated pin 244 is inserted through loops 246 on side 237. Thus, hair board 222 can be used in hair straitening procedures in a fashion explained above with reference to hair board 22. It will be understood that many and various other forms might be adapted to allow pins 242 and 244 to be removably attached to hair board 222.

Figure 13:
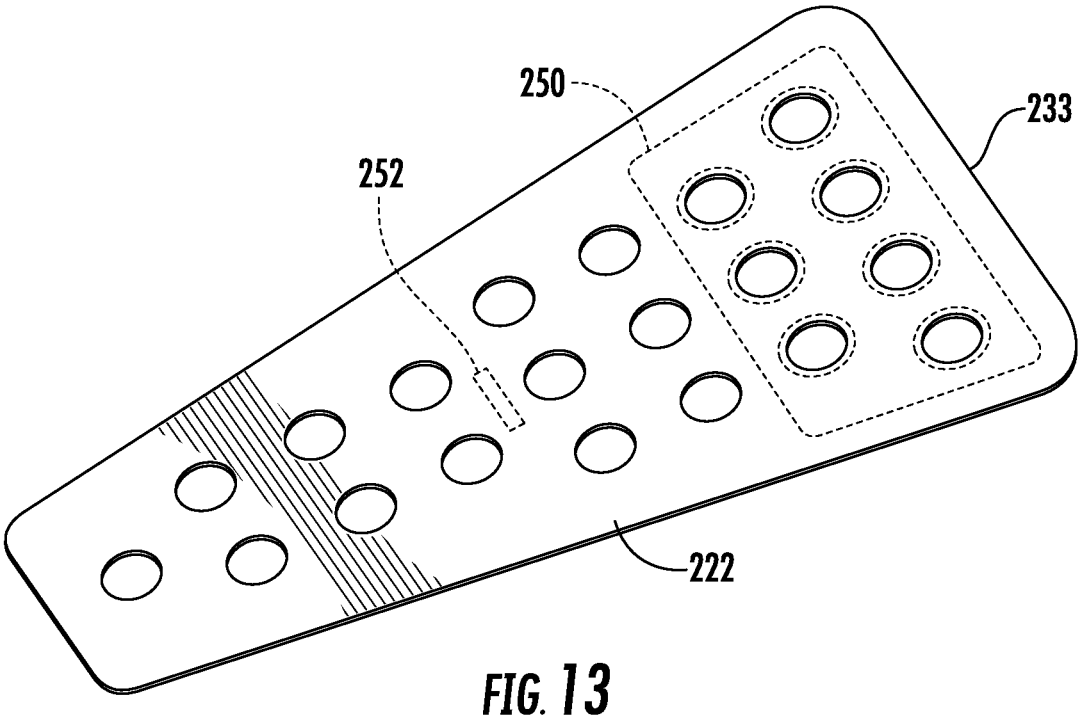
FIG. 13 is a top perspective view of the hair board of FIG. 12 with the side rails removed.
Figure 14:
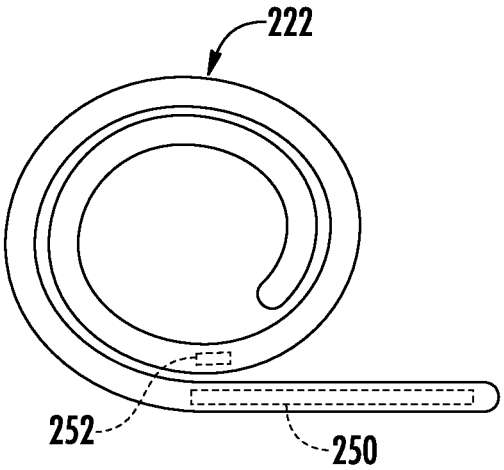
FIG. 14 is a side view of the hair board of FIG. 12, as seen in FIG. 13, in a rolled orientation for use in a hair curling procedure.

Referring additionally to FIGS. 13 and 14, some specific features that can be included in hair board 222 are illustrated. For example, by fabricating hair board 222 from flexible plastic and removing pins 242 and 244, board 222 can be rolled as illustrated in FIG. 14 to form a curler for curling hair rather than straightening the hair. In this preferred embodiment, hair board 222 includes an optional rigid over-molded insert 250 formed of stiffer plastic, metal, etc. to provide a handle for easier operation during the curling process. While insert 250 is illustrated as positioned adjacent widened end 233, it should be understood that it could extended or be positioned in an extended portion beyond widened end 233.

Also illustrated is a small optional magnet 252 embedded in hair board 222 at approximately a mid-point. In this specific embodiment, insert 250 is a metal that will attract magnet 252 (e.g. stainless steel, etc.) Magnet 252 is positioned in hair board 222 so to be adjacent and attracted to insert 250 with hair board 222 in the rolled position, as illustrated in FIG. 14. Thus, magnet 252 and insert 250 cooperate to hold hair board 222 in the rolled position.

Depending upon the specific application, magnet 252 may be increased in size or number to perform the desired holding operation.

Figure 15:
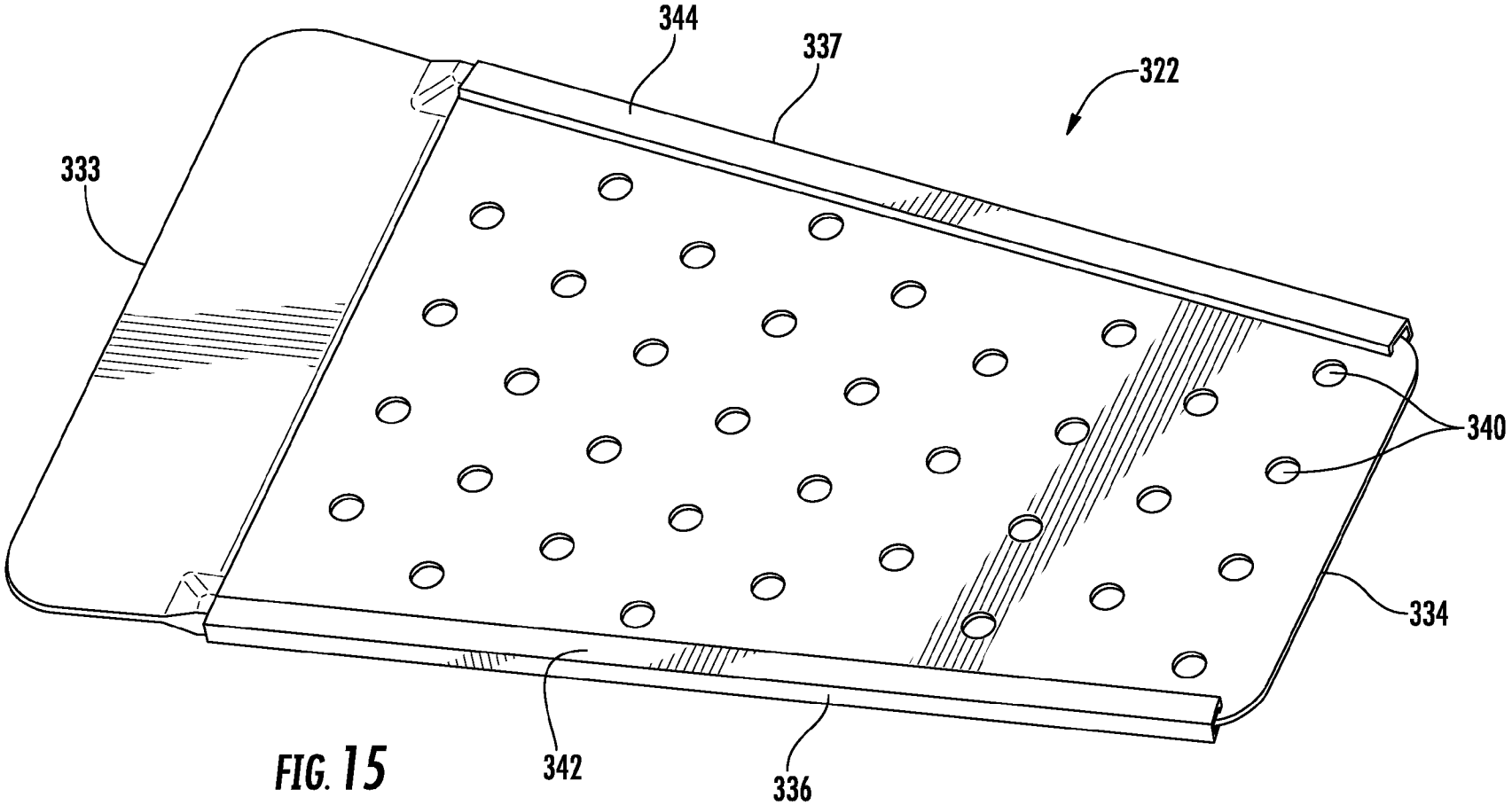
FIG. 15 is a top perspective view of another example of a hair board useful in hair straightening and/or hair curling procedures.
Figure 16:
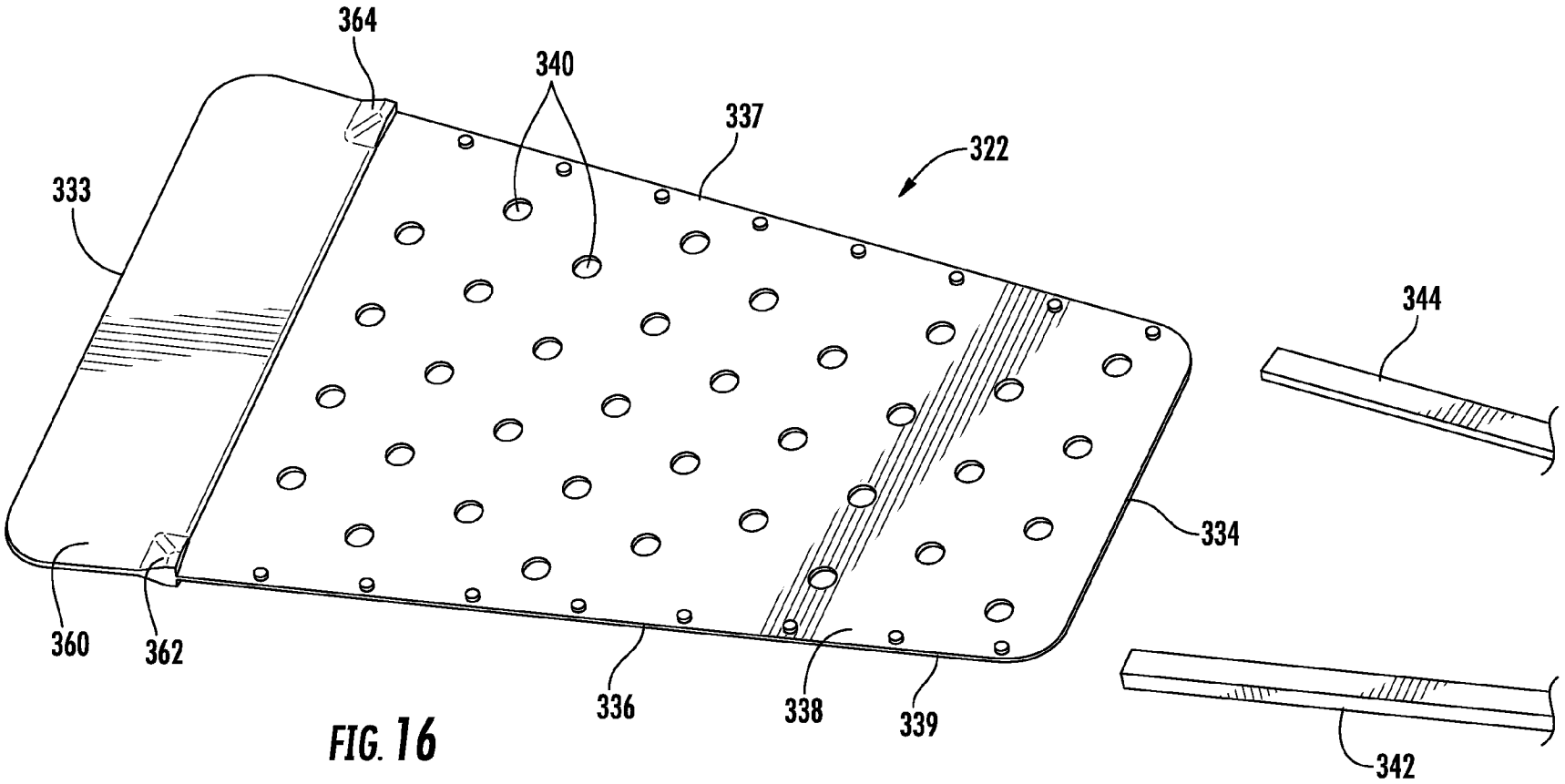
FIG. 16 is a top perspective view of the hair board of FIG. 15 with the side rails removed.
Figure 17:
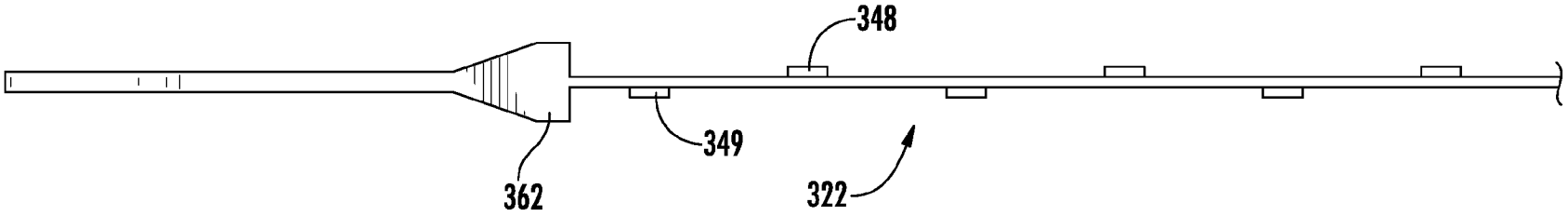
FIG. 17 is a side view of the hair board of FIG. 15 as seen in FIG. 16 and ready to be rolled into a hair curling orientation.

Turning to FIGS. 15, 16, and 17, another example of a hair board 322 convertible between a hair straightening device and a hair curling device is illustrated. Hair board 322, in a preferred embodiment, is a flat, planar member having a widened end 333, a narrowed end 334, side edges 336 and 337 extending therebetween, and opposed surfaces 338 and 339 (not visible). In this preferred embodiment, hair board 322 is preferably approximately 7 inches long (side edges 336 and 337), approximately 4 inches wide at widened end 333, and approximately 2 inches wide at narrowed end 334. It will be understood that the measurements expressed are for exemplary purposes only and different lengths and widths can be included for special purposes or applications (e.g. see the ranges set forth above). Hair board 322 further includes a plurality of apertures 340 extending therethrough from surface 338 to surface 339. In this preferred embodiment hair board 322 is fabricated of flexible plastic, such as silicone or the like. The plurality of apertures 340 permit airflow therethrough to facilitate drying the hair carried thereby, either from blow drying or natural air drying.

Figure 18:
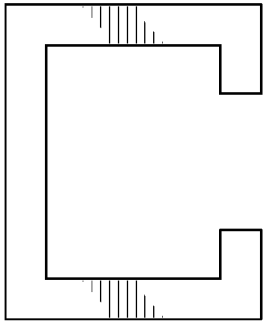
FIG. 18 is a cross-sectional view of the side rails illustrated in FIGS. 15 and 16.

In this specific example, elongated pins or side rails 342 and 344 are removably attached to sides 336 and 337, respectively. Side rails 342 and 344 are constructed with a generally C-shaped cross-section as illustrated in FIG. 18 so as to be easily slid into engagement (see FIG. 15) on sides 336 and 337 when using hair board 322 as a hair straightening device or removed (see FIG. 16) when using hair board 322 as a hair curling device. Hair board 322 is provided with bumps 348 and 349 on the upper surface 338 and lower surface 339, respectively, which frictionally and removably hold side rails 342 and 344 from undesirable lateral or longitudinal movement. Side rails 342 and 344 are formed from some relatively stiff plastic or light metal material.

In this specific example, hair board 322 is formed with a relatively stiff portion 360 adjacent widened end 333 which operates as a convenient handle when using hair board 322 as a hair curling device. Rail stops 362 and 364 are provided on stiff portion 360 at sides 336 and 337 to limit longitudinal movement of side rails 342 and 344, respectively. In some specific applications it may be convenient to form rail stops 362 and 364 with lateral slots (not illustrated) to receive and hold sides 336 and 337 of hair board 322 in a rolled position for hair curling procedures.

Thus, several examples of new and improved hair shaping devices and methods of use have been disclosed. Specifically, new and improved hair straightening devices that are easier to use and are less expensive to provide and store are disclosed. Further, examples of new and improved hair shaping devices that are useful in both hair straightening and hair curling projects are disclosed.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A hair styling accessory comprising:

an elongated and rigid hair board having a widened end and a narrowed end with elongated edges extending between the widened end and the narrowed end, a plurality of holes extending through the hair board from an upper surface to a lower surface; and at least one separate clip having open and closed orientations and biased into the closed orientation, the at least one clip positioned in the closed orientation over the hair board and to directly grip a lock of hair against one of the upper surface and the lower surface of the hair board at a location between the wide end and the narrow end.

2. The hair styling accessory as claimed in claim 1 wherein the narrowed end of the elongated hair board is in a range of one inch to three inches long, the widened end of the elongated hair board is in a range of three inches to five inches long, and the elongated edges are in a range of five inches to eight inches long.

3. The hair styling accessory as claimed in claim 1 wherein the at least one clip includes a pair of combs each having a plurality of straight teeth and joined together in an overlying relationship with the teeth of one comb overlying the teeth of another comb, the combs are movable between the open orientation wherein the teeth of the combs are angularly spaced apart and the closed orientation wherein the teeth of the combs are positioned adjacent one another.

4. The hair styling accessory as claimed in claim 1 wherein the at least one clip includes an end-clip having open and closed orientations and biased into the closed orientation, the at least one end-clip designed to be positioned in the closed orientation over the narrowed end of the hair board and to grip a lock of hair against one of the upper surface and the lower surface, and at least one side-clip having open and closed orientations and biased into the closed orientation, the at least one side-clip designed to be positioned in the closed orientation over one of the elongated edges of the hair board and to grip the lock of hair against one of the upper surface and the lower surface.

5. The hair styling accessory as claimed in claim 4 wherein the at least one end-clip has a length less than the width of narrowed end of the hair board and extends from the narrowed end toward the widened end when properly positioned on the hair board.

6. The hair styling accessory as claimed in claim 4 wherein the at least one side-clip includes a pair of combs each having a plurality of straight teeth and joined together in an overlying relationship with the teeth of one comb overlying the teeth of another comb, the combs are movable between the open orientation wherein the teeth of the combs are angularly spaced apart and the closed orientation wherein the teeth of the combs are positioned adjacent one another.

7. The hair styling accessory as claimed in claim 6 wherein the at least one side-clip has a length less than the length of the elongated edges, and extends transversely from one of the elongated edges to the other of the elongated edges when properly positioned on the hair board.

8. The hair styling accessory as claimed in claim 1 wherein the at least one clip comprise an elongated upper jaw and an elongated lower jaw, the lower jaw and upper jaw being pivotally attached together adjacent one end by means of a pivot pin extending through inwardly directed ears, a spring biasing the jaws into a closed orientation, and a portion of each jaw extending beyond the pivot pin and forming a grip for moving the jaws from the closed orientation to an open orientation in which they are angularly separated.

9. The hair styling accessory as claimed in claim 8 wherein the elongated upper jaw and the elongated lower jaw each have a width less than approximately an inch.

* * * * *